US008382216B2

(12) United States Patent
Favaro et al.

(10) Patent No.: US 8,382,216 B2
(45) Date of Patent: Feb. 26, 2013

(54) ELECTRIC HOUSEHOLD APPLIANCE

(75) Inventors: Daniele Favaro, Pramaggiore (IT); Reynaldo Aramis Nadolny, Webster City, IA (US); Brian Douglas Ripley, Webster City, IA (US)

(73) Assignee: Electrolux Home Products Corporation N.V., Brussels (BE)

( * ) Notice: Subject to any disclaimer, the term of this patent is extended or adjusted under 35 U.S.C. 154(b) by 337 days.

(21) Appl. No.: 12/811,118

(22) PCT Filed: Dec. 16, 2008

(86) PCT No.: PCT/EP2008/010707

§ 371 (c)(1),
(2), (4) Date: Aug. 12, 2010

(87) PCT Pub. No.: WO2009/083135

PCT Pub. Date: Jul. 9, 2009

(65) Prior Publication Data

US 2010/0295428 A1 Nov. 25, 2010

(30) Foreign Application Priority Data

Dec. 31, 2007 (EP) ..... 07150491

(51) Int. Cl.
*A47B 77/06* (2006.01)

(52) U.S. Cl. ..... 312/228; 312/325; 16/389; 16/286

(58) Field of Classification Search ..... 312/228, 312/325–329; 16/389, 286
See application file for complete search history.

(56) References Cited

U.S. PATENT DOCUMENTS

| | | | | |
|---|---|---|---|---|
| 2,708,293 | A | | 5/1955 | Sherman |
| 2,899,717 | A | | 8/1959 | Billings et al. |
| 3,321,100 | A | | 5/1967 | Toma |
| 5,113,562 | A | * | 5/1992 | Studt ..... 29/401.1 |
| 5,253,433 | A | * | 10/1993 | Frey ..... 34/603 |
| 5,496,104 | A | | 3/1996 | Arnold et al. |
| 6,065,612 | A | | 5/2000 | Rinderer |

(Continued)

FOREIGN PATENT DOCUMENTS

| | | |
|---|---|---|
| EP | 0 844 354 | 5/1998 |
| JP | 2007-195859 | 8/2007 |

(Continued)

OTHER PUBLICATIONS

International Search Report and Written Opinion mailed Jun. 16, 2009 in corresponding International Application No. PCT/EP2008/010707.

*Primary Examiner* — Hanh V Tran
(74) *Attorney, Agent, or Firm* — Banner & Witcoff, Ltd

(57) ABSTRACT

An electric household appliance (1) having an outer box casing (2), in turn having, on the front face (2*a*), an opening (3) for access to the inside of the appliance; and a door (4) fixed to the box casing (2) by a hinge (5) located close to the peripheral edge (3*a*) of the opening (3) and designed to allow the door (4) to rotate to and from a closed position, in which the body of the door (4) rests on the front face (2*a*) of the box casing (2), thus closing the opening (3); the hinge (5) of the door (4) is designed to selectively and alternatively fit to the box casing (2) firmly, but in easily removable manner, in two distinct positions on opposite sides of the front opening (3) of said household appliance (1).

13 Claims, 3 Drawing Sheets

U.S. PATENT DOCUMENTS

| | | | | |
|---|---|---|---|---|
| 6,938,444 | B2 * | 9/2005 | Hong et al. | 68/196 |
| 7,363,781 | B2 | 4/2008 | Erickson | |
| 7,581,414 | B2 * | 9/2009 | Kim et al. | 68/196 |
| 7,748,243 | B2 * | 7/2010 | Park et al. | 68/196 |
| 8,087,185 | B2 * | 1/2012 | Leclerc | 34/603 |
| 8,162,418 | B2 * | 4/2012 | Kocak et al. | 312/228 |
| 2004/0083769 | A1 * | 5/2004 | Kim et al. | 68/12.02 |
| 2006/0101873 | A1 * | 5/2006 | Kim et al. | 68/196 |
| 2006/0156767 | A1 * | 7/2006 | Kim et al. | 68/175 |
| 2006/0255700 | A1 * | 11/2006 | Park et al. | 312/228 |
| 2006/0265899 | A1 | 11/2006 | Renzo | |
| 2006/0265959 | A1 * | 11/2006 | Renzo | 49/381 |

FOREIGN PATENT DOCUMENTS

| | | |
|---|---|---|
| WO | 03/004754 | 1/2003 |
| WO | 2005/042891 | 5/2005 |

* cited by examiner

ELECTRIC HOUSEHOLD APPLIANCE

BACKGROUND OF THE INVENTION

The present invention relates to an electric household appliance.

More specifically, the present invention relates to a rotary-drum laundry washing machine or drier, to which the following description refers purely by way of example.

As is known, rotary-drum washing machines and driers normally comprise a substantially parallelepiped-shaped outer box casing with a normally circular front loading and unloading opening for access to the inside of the machine; and a door hinged to the outer box casing, close to the peripheral edge of the opening, to rotate about a vertical axis to and from a closed position, in which the body of the door rests against the front face of the box casing to fluidtight seal the opening in the front face.

Unfortunately, in currently marketed washing machines and driers, the position of the hinge connecting the door to the outer box casing, and hence the position of the axis of rotation of the door with respect to the opening in the front face of the appliance, is decided at the appliance design and/or assembly stage, thus limiting the extent to which the appliance can be adapted to the confines of the place in which it is used, and so creating numerous problems for the user operating the appliance daily.

Such is the case, for example, of a washing machine, in which the door hinge is located to the right of the loading and unloading opening, and which is installed in a highly confined and/or overfurnished space preventing the door from being fully opened; whereas the problem would not exist if the door hinge were located to the left of the loading and unloading opening of the appliance.

SUMMARY OF SELECTED INVENTIVE ASPECTS

It is an object of the present invention to provide an electric household appliance designed to adapt better to the confines of the place in which it is used.

According to the present invention, there is provided an electric household appliance as claimed in claim 1 and preferably, though not necessarily, in any one of the claims depending directly or indirectly on claim 1.

BRIEF DESCRIPTION OF THE DRAWINGS

A non-limiting embodiment of the present invention will be described by way of example with reference to the accompanying drawings, in which.

DETAILED DESCRIPTION OF ILLUSTRATIVE EMBODIMENTS

Figure 1:
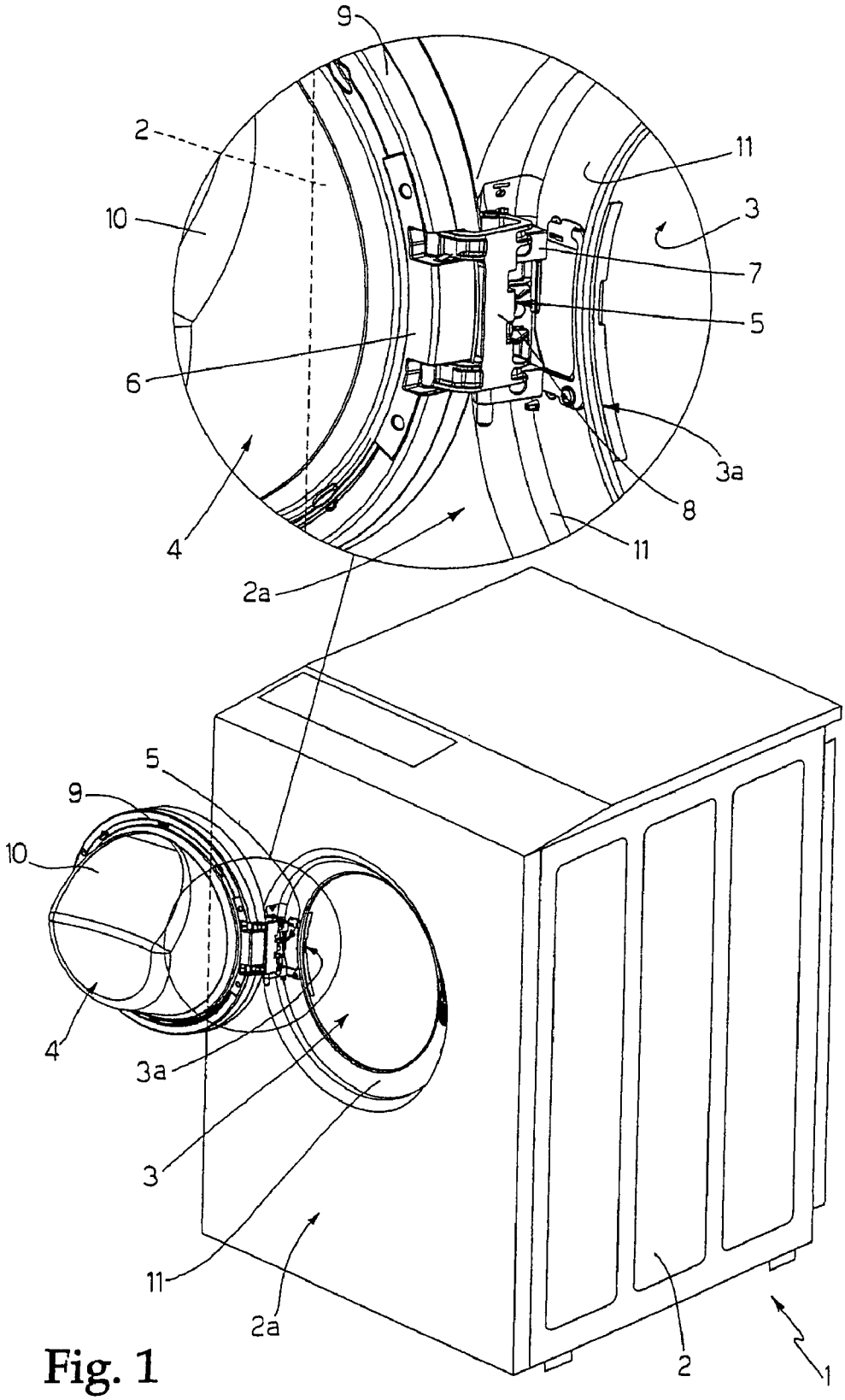
FIG. 1 shows a view in perspective, with parts removed for clarity, of a washing machine in accordance with the teachings of the present invention.

Number 1 in FIG. 1 indicates as a whole an electric household appliance, and more specifically a home washing machine or drier comprising a substantially parallelepiped-shaped outer box casing 2, the front face 2*a* of which has a preferably, though not necessarily, circular front loading and unloading opening 3 for access to the inside of the machine; and a door 4 hinged to box casing 2, close to the peripheral edge 3*a* of opening 3, to rotate freely, about a preferably, though not necessarily, vertical axis, between a closed position, in which the body of door 4 rests against front face 2*a* of box casing 2 to fluidtight seal opening 3 in the front face, and a fully-open position, in which door 4 is swung back to the side of loading and unloading opening 3 of the appliance, and substantially rests against front face 2*a* of box casing 2.

More specifically, door 4 is connected to box casing 2 by a hinge 5 having two axes of rotation, and which comprises a first anchoring plate 6 fixed firmly, but in easily removable manner, to the body of door 4; a second anchoring plate 7 fixed firmly, but in easily removable manner, to box casing 2, close to the peripheral edge 3*a* of opening 3; and, finally, a rigid, substantially U-shaped connecting rod 8, the two ends 8*a* and 8*b* of which pivot in freely rotating manner on anchoring plates 6 and 7 respectively, so as to rotate, with respect to the two anchoring plates 6 and 7, about two parallel axes of rotation A and B, which are both located outside box casing 2, at a predetermined distance from front face 2*a*, and are preferably, though not necessarily, vertical.

In the example shown, connecting rod 8 is fitted to anchoring plate 7 to rotate, about axis A, between a first operating position, in which it sets door 4 to the closed position, and a second operating position (FIG. 1), in which it sets door 4 to the fully-open position, i.e. resting on front face 2*a* of box casing 2, and obviously swung back to the side of opening 3.

Unlike known hinges, anchoring plate 7 is designed to be fixable to box casing 2 selectively and alternatively in two different positions located on box casing 2, close to peripheral edge 3*a* of front opening 3, and on opposite sides of opening 3 of appliance 1; while connecting rod 8 is reversible and designed to fit to anchoring plate 7 firmly, but in easily removable manner, so anchoring plate 7 can be separated temporarily from the rest of hinge 5.

In other words, connecting rod 8 is designed so that door 4 can rotate to and from the closed position regardless of the position of anchoring plate 7 on box casing 2.

With reference to FIG. 1, in the example shown, electric household appliance 1 is defined by a home washing machine 1 with a circular front opening 3, and door 4 substantially comprises a rigid, substantially circular supporting rim 9, the central hole of which is substantially the same shape as the perimeter of opening 3 of the appliance; and a central cup-shaped body 10 made of safety glass or other transparent material, and which is fixed rigidly inside rim 9, and is sized to engage and fluidtight seal loading and unloading opening 3 of the appliance firmly, but in easily removable manner.

Front face 2*a* of box casing 2, on the other hand, has a rigid circular rim 11 surrounding loading and unloading opening of the appliance, and the contour of which flares to accommodate rim 9 of door 4.

As regards hinge 5 of door 4, anchoring plate 6 is designed to fit inside a seat formed in rim 9, and is anchored, inside the seat, to the body of rim 9 firmly, but in easily removable manner, by means of known through screws (not shown); and anchoring plate 7 is designed to fit selectively and alternatively inside two different seats formed in rim 11, on opposite sides of loading and unloading opening 3 of the appliance, and is anchored, inside the seat, to the body of rim firmly, but in easily removable manner, by means of known through screws (not shown).

In the example shown, the two seats for housing anchoring plate 7 are formed in rim 11 diametrically opposite each other and on opposite sides of the vertical centre plane of opening 3; and anchoring plate 7 can be fitted inside either of the seats by rotating anchoring plate 7 about a horizontal axis locally perpendicular to the plane of opening 3.

Figure 3:
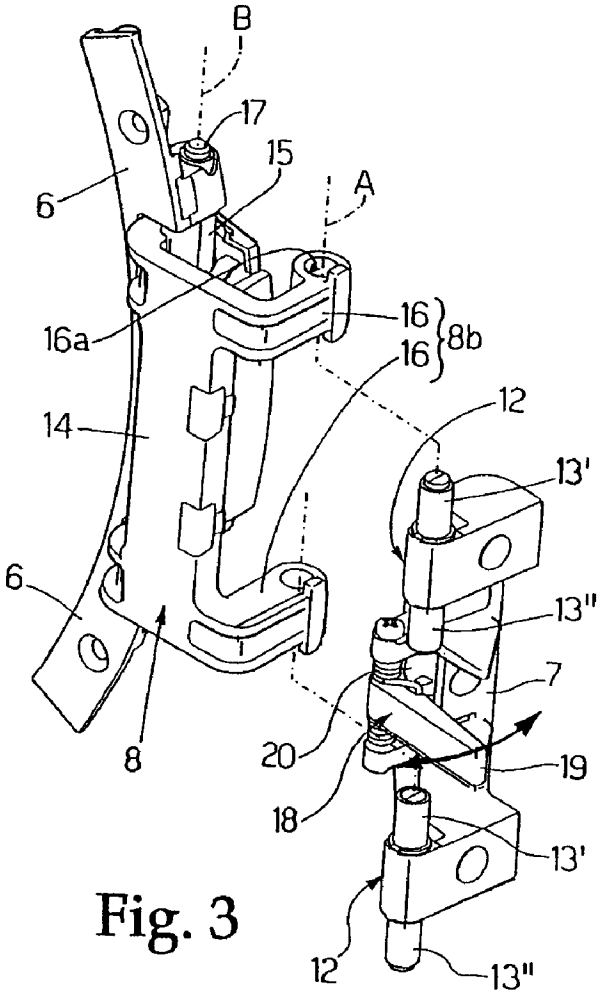
FIG. 3 shows a partly exploded view in perspective of the door hinge of the FIGS. 1 and 2 washing machine.
Figure 2:
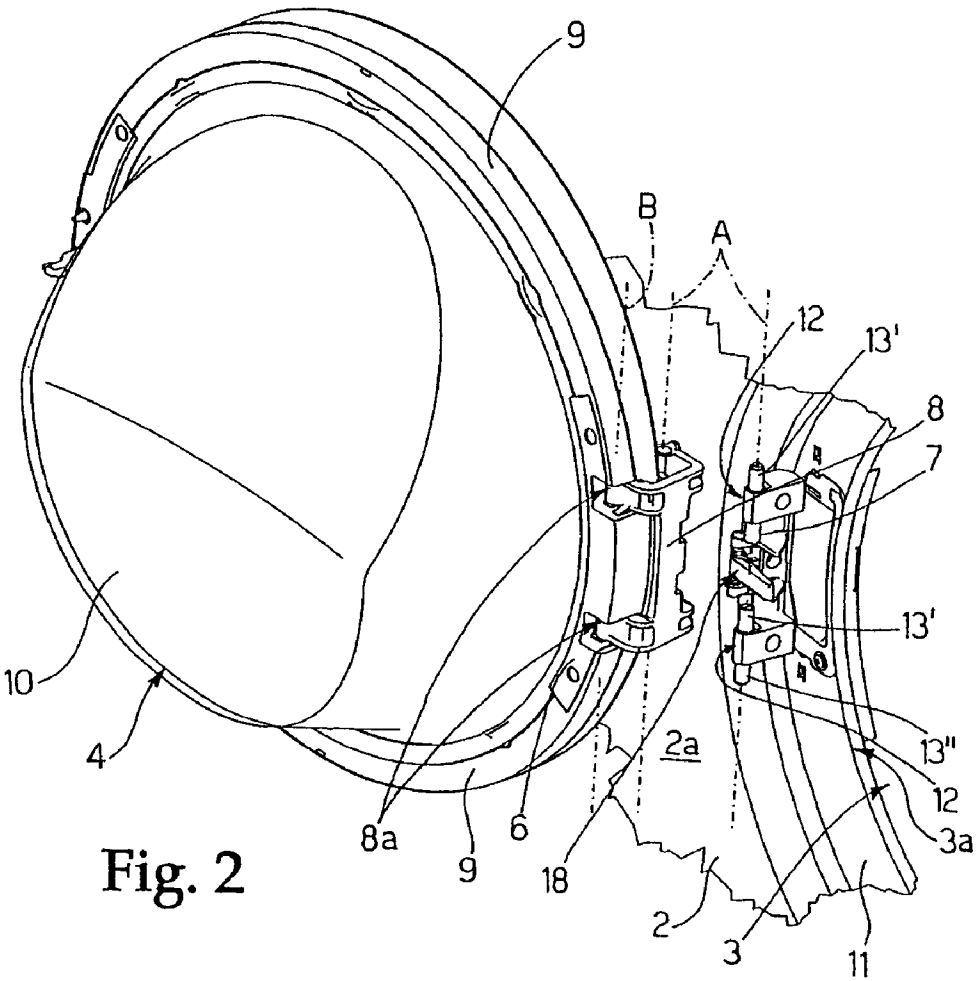
FIG. 2 shows a larger-scale, partly exploded detail of the FIG. 1 washing machine.

With reference to FIGS. 2 and 3, to reversibly connect the various component parts of hinge 5, anchoring plate 7 comprises one or more projecting appendixes 12, which project from the main body of the anchoring plate—in a direction locally substantially perpendicular to front face 2*a* of box casing 2, and remaining locally parallel to and facing each other—up to axis of rotation A of connecting rod 8; and two projecting pins 13' and 13", which project from the two opposite lateral sides of the distal end of each projecting appendix 12 of anchoring plate 7, while remaining locally coaxial with axis of rotation A of connecting rod 8.

More specifically, in the example shown, anchoring plate 7 has two projecting appendixes 12, which project, parallel to and facing each other, from the main body of the anchoring plate; and the axis of rotation A of connecting rod 8 intersects the distal ends of both projecting appendixes 12 of the anchoring plate, at a predetermined distance from front face 2*a* of box casing 2.

With reference to FIGS. 2 and 3, connecting rod 8 comprises a central portion 14 and two pairs of projecting arms 15 and 16, which project from opposite sides of central portion 14, while remaining locally parallel to and facing each other, to form a rigid, substantially U-shaped structure.

The two arms 15 forming end 8*a* of connecting rod 8 extend from central portion 14 to axis of rotation B of connecting rod 8, and are fixed to anchoring plate 6 in freely rotating manner by a through pin 17 coaxial with axis B, so that the whole of connecting rod 8 can rotate in cantilevered manner about axis B with respect to anchoring plate 6.

The two arms 16 forming end 8*b* of connecting rod 8 extend from central portion 14 to axis of rotation A of connecting rod 8, and are so spaced apart that each arm 16 is aligned with a respective projecting appendix 12 of anchoring plate 7, and can therefore selectively and alternatively engage in freely rotating manner either one of the two pins 13' and 13" projecting from the distal end of the relative projecting appendix 12, so that, in either case, the whole of connecting rod 8 can rotate freely about axis A with respect to anchoring plate 7.

More specifically, the distal end of each arm 16 of connecting rod 8 has a transverse through hole 16*a* coaxial with axis A and complementary in section to pins 13' and 13", so as to fit in freely rotating manner on either of pins 13', 13"projecting from the distal end of projecting appendix 12.

Being reversible, connecting rod 8 can be fixed irremovably and in rotary manner to anchoring plate 6.

With reference to FIGS. 2 and 3, two-rotation-axis hinge 5 preferably, though not necessarily, also comprises an elastic member 18, which exerts elastic force on connecting rod 8 to move connecting rod 8 out of the first operating position, and so move door 4 out of the closed position.

Preferably, though not necessarily, elastic member 18 exerts such force on connecting rod 8 as to push connecting rod 8 into, and keep it in, the second operating position (FIG. 1), and so keep door 4 in the fully-open position.

In the example shown, elastic member 18 comprises a lever or trigger 19 which has one end fixed in freely rotating manner to anchoring plate 7, so as to rotate in cantilevered manner about an axis of rotation locally parallel to axis A while remaining in a plane perpendicular to axis A, and a helical spring 20 which is fitted to the supporting pin of lever or trigger 19 to hold lever or trigger 19 on the facing central portion 14 of connecting rod 8, and at the same time exert elastic force on connecting 8 to rotate it about axis A into the second operating position (FIG. 1), in which door 4 is positioned resting on front face 2*a* of box casing 2, swung back to the side of opening 3 of the appliance.

Operation of electric household appliance 1 as a whole will be clear from the foregoing description, with no further explanation required.

As regards hinge 5 of door 4, on the other hand, this has a reversible structure, so it can be fitted to box casing 2 of the machine, on opposite sides of loading and unloading opening 3.

Figure 4:
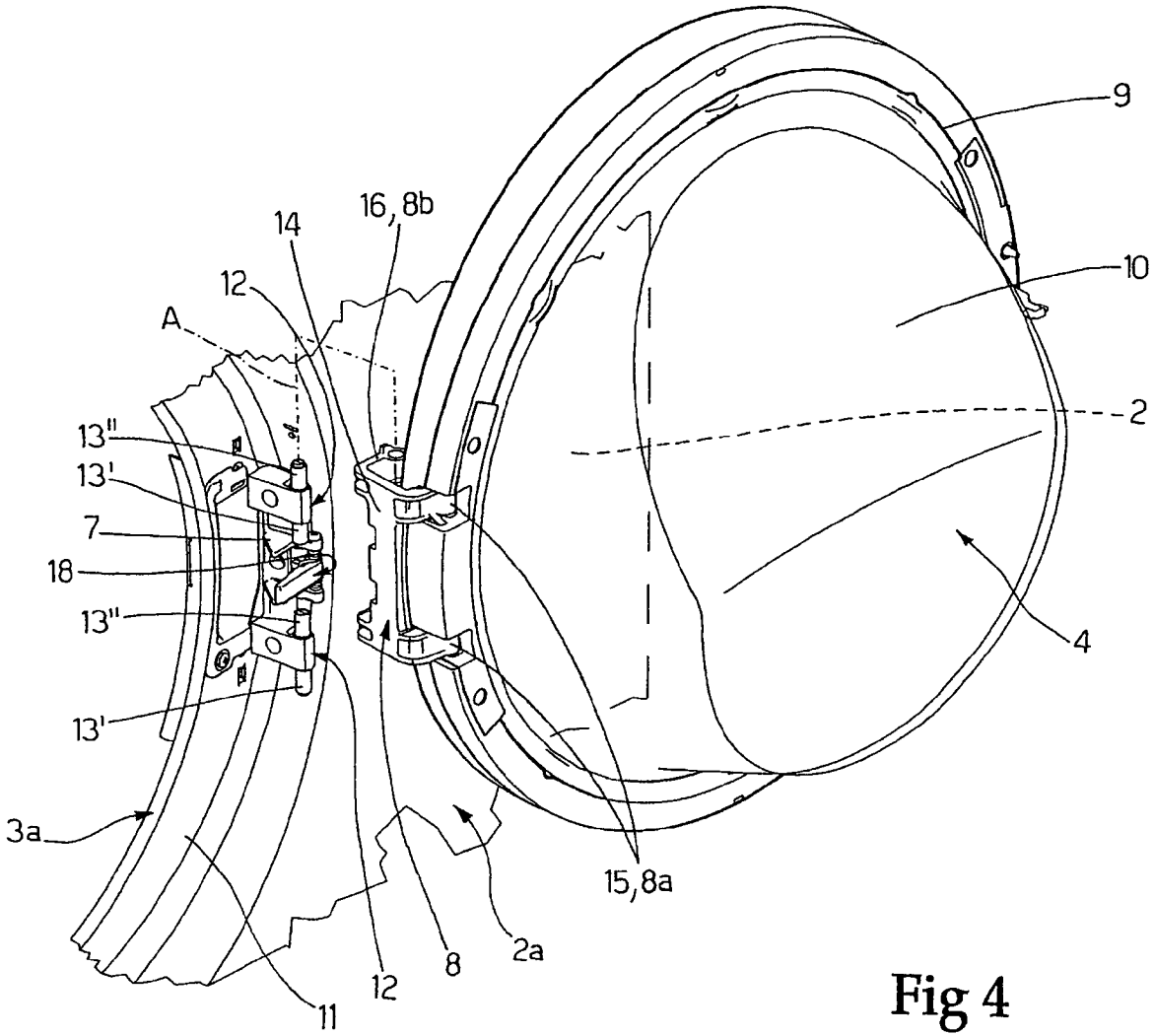
FIG. 4 shows a view in perspective, with parts removed for clarity, of the FIG. 1 washing machine in a different operating configuration.

With reference to FIGS. 2 and 4, hinge 5 in fact can assume two distinct operating configurations enabling it to be fitted on the left and right side respectively of loading and unloading opening 3 of the appliance. In the first case, anchoring plate 7 is fixed on the left side of rim 11 of box casing 2, with pins 13' facing upwards, and the distal ends of the two arms 16 of connecting rod 8 are fitted in freely rotating manner on pins 13'. In the second case, anchoring plate 7 is fixed, inverted, on the right side of rim 11 of box casing 2, with pins 13" facing upwards, and the distal ends of the two arms 16 of connecting rod 8 are fitted in freely rotating manner on pins 13".

With reference to FIGS. 2 and 4, to further simplify transfer of hinge 5 from one side to the other of front opening 3 of the appliance when dealing with non-reversible doors, rim 9 of door 4 preferably, though not necessarily, also has two separate seats for anchoring plate 6, which are formed symmetrically in the body of rim 9, on opposite sides of the central plane of the rim; and anchoring plate 6, inverted beforehand, can be fixed in both above cited positions to rim 9 by means of through screws.

In other words, anchoring plate 6 is also designed be fixable firmly, but in easily removable manner, to the body of door 4 selectively and alternatively in two distinct positions on opposite sides of the body of door 4. This feature allows hinge 5 to be moved from one side to the other of opening 3 without rotating the door 4 body 180° about a horizontal axis through the centre of opening 3 of appliance 1.

The advantages of the design of hinge 5 of door 4 are obvious: the washing machine 1 or other electric household appliance allows the user to choose the opening mode of door 4 according to the confines of the place in which it is used.

Moreover, anchoring plate 7 can be transferred from one side to the other of rim 11 of box casing 2 extremely easily by the user simply manually unscrewing the screws securing anchoring plate 7 to box casing 2.

Clearly, changes may be made to the washing machine 1 or other electric household appliance as described herein without, however, departing from the scope of the present invention.

The invention claimed is:

1. An electric household appliance comprising an outer box casing having, on a front face, an opening for access to the inside of the appliance; and a door fixed to the box casing by a hinge located adjacent a peripheral edge of said opening and designed to allow the door to rotate to and from a closed position, in which a body of the door rests on the front face of the box casing, thus closing the opening; said electric household appliance being characterized in that said hinge of the door comprises a first anchoring plate fixed to the body of the door, a second anchoring plate fixed firmly, in a removable manner, to the box casing, and a connecting rod having two ends which are hinged in freely rotating manner to respective said anchoring plates so as to rotate, with respect to said plates, about two parallel axes of rotation; said second plate being designed to be fixable to said box casing selectively and alternatively in two distinct positions on opposite sides of said opening; and said connecting rod being designed to engage said second plate firmly, in a removable manner, and to allow the door to rotate to and from said closed position regardless of the position of said second plate on said box casing among said two distinct positions.

2. An electric household appliance as claimed in claim 1, characterized in that said first plate is designed to be fixable firmly, in a removable manner, to the body of said door selectively and alternatively in two distinct positions on opposite sides of the body of said door.

3. An electric household appliance as claimed in claim 1, characterized in that the two ends of said connecting rod are hinged in freely rotating manner to said first plate and said second plate respectively, so as to rotate, with respect to both said plates, about two axes of rotation, both of which are located outside the box casing and a predetermined distance from the front face of said box casing.

4. An electric household appliance as claimed in claim 3, characterized in that said connecting rod is substantially U-shaped.

5. An electric household appliance as claimed in claim 1, characterized in that said second plate comprises at least one projecting appendix projecting, in a direction locally substantially perpendicular to said front face, to a first axis of rotation of the connecting rod; and a pair of projecting pins projecting from two lateral sides of the distal end of said projecting appendix, while remaining locally coaxial with said first axis of rotation of the connecting rod; the end of the connecting rod which engages said second plate having at least one arm projecting to said first axis of rotation and designed to selectively and alternatively fit in freely rotating manner on either of the two projecting pins projecting from the distal end of said projecting appendix.

6. An electric household appliance as claimed in claim 5, characterized in that the distal end of said arm has a transverse through hole coaxial with said first axis of rotation of the connecting rod, and having a section complementary to that of the projecting pins of said projecting appendix, so as to fit in freely rotating manner on either one of the projecting pins.

7. An electric household appliance as claimed in claim 6, characterized in that said second plate comprises two projecting appendixes projecting to said first axis of rotation of the connecting rod, while remaining locally parallel to and facing each other; each projecting appendix having a pair of projecting pins projecting from the two lateral sides of the distal end of the projecting appendix, while remaining locally coaxial with said first axis of rotation; and the end of the connecting rod which engages said second plate having two arms projecting said first axis of rotation, and each of which is designed to selectively and alternatively fit in freely rotating manner on either of the two projecting pins projecting from the distal end of a respective projecting appendix.

8. An electric household appliance as claimed in claim 1, characterized in that said hinge also comprises an elastic member, which exerts elastic force on said connecting rod to move the door out of its closed position.

9. An electric household appliance as claimed in claim 8, characterized in that said elastic member is located on said second plate, between the two projecting appendixes.

10. An electric household appliance as claimed in claim 9, characterized in that said elastic member comprises a lever, which has one end fixed in freely rotating manner to said second plate so as to rotate in cantilevered manner about an axis of rotation locally parallel to said first axis of rotation of the connecting rod, while remaining in a plane perpendicular to the first axis of rotation; and a spring acts on said lever to hold it resting on a facing surface of the connecting rod, while at the same time exerting elastic force on said connecting rod to rotate it about the first axis of rotation to move the door out of the closed position.

11. An electric household appliance as claimed in claim 1, said appliance comprising a laundry washing machine or laundry drier.

12. An electric household appliance as claimed in claim 2, characterized in that the two ends of said connecting rod are hinged in freely rotating manner to said first plate and said second plate respectively, so as to rotate, with respect to both said plates, about two axes of rotation, both of which are located outside the box casing and a predetermined distance from the front face of said box casing.

13. An electric household appliance as claimed in claim 12, characterized in that said connecting rod is substantially U-shaped.

* * * * *